US005473417A

United States Patent [19]

Hirano

[11] Patent Number: 5,473,417

[45] Date of Patent: Dec. 5, 1995

[54] DEVELOPING APPARATUS HAVING TONER SUPPLY ROLLER APPLIED WITH BIAS VOLTAGE VARIED IN ACCORDANCE WITH CHANGES IN PHYSICAL PROPERTIES THEREOF

[75] Inventor: Kouji Hirano, Yokosuka, Japan

[73] Assignee: Kabushiki Kaisha Toshiba, Kawasaki, Japan

[21] Appl. No.: 172,284

[22] Filed: Dec. 23, 1993

[30] Foreign Application Priority Data

Dec. 25, 1992 [JP] Japan ..... 4-345029

[51] Int. Cl.[6] ..... G03G 15/00

[52] U.S. Cl. ..... 355/246; 355/259

[58] Field of Search ..... 355/208, 245, 355/246, 253, 259, 265

[56] References Cited

U.S. PATENT DOCUMENTS 3,152,012 10/1964 Schaffert ..... 118/637
5,095,341 3/1992 Yoshida et al. ..... 355/259

FOREIGN PATENT DOCUMENTS 63-237083 10/1988 Japan ..... 355/259
3-102372 4/1991 Japan .
3-174568 7/1991 Japan .
4-171469 6/1992 Japan .

OTHER PUBLICATIONS

Hosoya et al., "Contact–Type Development System Using Monocomponent Nonmagnetic Toner", EP–7, pp. 25–28 (Jul. 1989), Toshiba R&D Center.

*Primary Examiner*—Joan H. Pendergrass
*Attorney, Agent, or Firm*—Foley & Lardner

[57] ABSTRACT

A developing apparatus of a one-component developer system includes a developing roller and a toner supply roller for supplying a toner to the developing roller. Predetermined bias voltages are applied from bias power supplies to these rollers, respectively. The apparatus is designed such that the bias voltage applied to the toner supply roller is variably controlled in accordance with changes in physical properties of the toner supply roller, which are determined from the number of the printing cycles, a voltage at a surface of the supply roller or a toner density at leading and end portion of a strip-like image pattern formed on the image carrying drum.

14 Claims, 13 Drawing Sheets

| | INITIAL STATE | AFTER 10000 SHEETS PRINTED |
|---|---|---|
| OUTER DIAMETER | 12.58mm | 11.85mm |
| RESISTANCE (SHAFT ROLLER) | 52MΩ | 127MΩ |
| HARDNESS (ASKER-C) | 44° | 36° |

FIG. 22

| NUMBER OF PRINTED SHEETS | BEFORE CORRECTION | | | AFTER CORRECTION | | |
|---|---|---|---|---|---|---|
| | BIAS VOLTAGE | RATE OF SOLID-PATTERN REPRO-DUCTION | TONER CONVEY-ING RATE | BIAS VOLTAGE | RATE OF SOLID-PATTERN REPRO-DUCTION | TONER CONVEY-ING RATE |
| 5,000 | -300V | 82% | 73% | -400V | 90% | 84% |
| 6,000 | -300V | 78% | 70% | -400V | 88% | 82% |
| 7,000 | -300V | 75% | 66% | -500V | 89% | 84% |
| 8,000 | -300V | 71% | 62% | -500V | 87% | 81% |
| 9,000 | -300V | 69% | 59% | -600V | 91% | 86% |
| 10K | -300V | 67% | 55% | -600V | 87% | 81% |

FIG. 23

| NUMBER OF PRINTED SHEETS x1000 | PRIOR ART | | PRESENT INVENTION | |
|---|---|---|---|---|
| | RATE OF SOLID-PATTERN REPRO-DUCTION | TONER CONVEY-ING RATE | RATE OF SOLID-PATTERN REPRO-DUCTION | TONER CONVEY-ING RATE |
| INITIAL STATE | 90% | 85% | 90% | 85% |
| 10 | 65% | 53% | 88% | 82% |

FIG. 24

| DENSITY DIFFERENCE | BEFORE CORRECTION | AFTER CORRECTION | |
|---|---|---|---|
| | RATE OF SOLID-PATTERN REPRO-DUCTION | TONER CONVEYING RATE | RATE OF SOLID-PATTERN REPRO-DUCTION |
| 0.05 | 85% | -320 V | 90 % |
| 0.1 | 80% | -380 V | 90 % |
| 0.15 | 73% | -460 V | 90 % |
| 0.2 | 67% | -590 V | 90 % |
| 0.3 | 61% | -600 V | 90 % |

DEVELOPING APPARATUS HAVING TONER SUPPLY ROLLER APPLIED WITH BIAS VOLTAGE VARIED IN ACCORDANCE WITH CHANGES IN PHYSICAL PROPERTIES THEREOF

BACKGROUND OF THE INVENTION

1. Field of the Invention

The present invention relates to a developing apparatus used in an image forming apparatus such as an electrophotographic copying machine or a laser printer to develop an electrostatic latent image formed on the surface of a photosensitive drum serving as an image carrier by using a one-component developer.

2. Description of the Related Art

Electrophotography is widely used as a technique of printing images on plain paper in a copying machine or a laser printer. Development systems in electrophotography are roughly classified into liquid development and dry development. Dry development is generally employed. Dry development systems are also classified into a two-component developer system and a one-component developer system. Recently, the one-component developer system has become increasingly popular especially in compact printers and compact copying machines.

In the one-component developer system, a developer contains no carrier (e.g., an iron powder or a ferrite powder), and the structure of a developing apparatus is simpler than that in the two-component developer system. For this reason, the one-component developer system is more advantageous in reducing the size and cost of a developing apparatus.

As one of such one-component developer systems, an impression development system is known. This system is characterized in that a toner or a toner carrier is brought into contact with an electrostatic latent image on a photosensitive drum at a substantially zero relative peripheral speed (see U.S. Pat. No. 3,152,012 and Jpn. Pat. Appln. KOKAI Publication Nos. 47-13088, 47-13089 and 3-102372, and the like).

According to this system, since no magnetic material is used, a developing apparatus and an image forming apparatus can be simplified and reduced in size. In addition, a color toner can be easily used.

Although a developing apparatus of the one-component developer system is advantageous in terms of simplification and reduction in size of an image forming apparatus, the one-component developer system is inferior to the two-component developer system in terms of the charging characteristics (rising characteristics) and conveying characteristics (conveying amount) of a toner. This is because the toner in the one-component developer system has no carrier for charging the toner and conveying the toner onto a developing roller. Especially when the conveying amount of the toner is smaller than the amount of the toner consumed in development, a decrease in image density occurs on a printed image.

For example, in printing a graphic pattern, which has recently become popular, since there are many solid portions (image portions having relatively large areas to which toner particles are attached), stabilization of the toner conveying amount is indispensable. For this purpose, in some case, a former or a developer supply roller (simply called an intermediate roller in many instances) is arranged to be in contact with a developing roller or brought into contact therewith with a predetermined bite amount so as to stably supply a toner onto the developing roller, and a certain potential difference is set between the applied voltage (developing bias voltage) to the developing roller and the developer supply roller so as to electrically convey the toner to the developing roller.

This developer supply roller generally consists of a foamed elastomer (so-called sponge) because of the necessity to protect the surface of the developing roller and convey a large amount of a toner. With such a roller, a stable toner conveying operation can be performed for a while after the use of the developing apparatus is started. However, as the developing apparatus is used, toner particles enter the foamed elastomer (to be simply referred to as the sponge hereinafter) to increase the hardness, reduce the outer diameter, and form a skin-like film on the sponge surface. As a result, the toner conveying amount (toner supply amount) of the sponge decreases as compared with its initial state.

SUMMARY OF THE INVENTION

It is, therefore, an object of the present invention to provide a developing apparatus which can ensure stable supply of a developer for a long period of time without being disturbed by changes in physical properties of a developer supply roller due to its service life, and can maintain excellent image states of solid images with a small decrease in density for a long period of time.

According to the present invention, there is provided an image forming apparatus for forming a latent image on an image carrying member, comprising: a developing roller for forming a developer image corresponding to the latent image on the image carrying member; a developer supplying roller, at least a surface of which is constituted by a resilient member contacting with the developing roller for supplying a developer to the developing roller; image transfer means for transferring the developer image formed on the image carrying member to a medium on which a visual image is being formed; bias voltage applying means including a switching unit for applying at least first and second bias voltages supplied to the developer supplying roller, the second bias voltage having an absolute value larger than that of the first bias voltage; and means for changing, via the switching unit, the first bias voltage applied by the bias voltage applying means to the second bias voltage when a predetermined number of image transfer cycles for transferring the developer image to the medium is performed.

In addition, according to the present invention, there is provided an image forming apparatus for forming a latent image on an image carrying member, comprising: a developing roller for forming a developer image corresponding to the latent image on the image carrying member; a developer supplying roller, at least a surface of which is constituted by a resilient member contacting with the developing roller for supplying the developer to the developing roller; image transfer means for transferring the developer image formed on the image carrying member to a medium on which a visual image is being formed; voltage applying means for applying to the developer supplying roller at least one of first and second bias voltages having a value for generating a predetermined voltage difference between the developing roller and the developer supplying roller, the second bias voltage having an absolute value larger than that of the first bias voltage; measuring means for measuring a surface potential of the developer supplying roller; and means for changing the first bias voltage applied by the voltage applying means to the second bias voltage to generate a predetermined potential difference between the developer supplying roller and the developing roller in accordance with a measuring result of the measuring means.

Furthermore, according to the present invention, there is provided an image forming apparatus for forming a latent image on an image carrying member, comprising: a developing roller for forming a developer image corresponding to the latent image on the image carrying member; a developer supplying roller, at least a surface of which is constituted by a resilient member contacting with the developing roller for supplying the developer to the developing roller; image transfer means for transferring the developer image formed on the image carrying member to a medium on which a visual image is being formed; voltage applying means for applying to the developer supplying roller at least one of first and second bias voltages having a value for generating a predetermined voltage difference between the developing roller and the developer supplying roller, the second bias voltage having an absolute value larger than that of the first bias voltage; measuring means for measuring a developing density of the developer image formed on the image carrying member; and means for changing the first bias voltage applied by the voltage applying means to the second bias voltage to generate a predetermined potential difference between the developer supplying roller and the developing roller in accordance with a measuring result of the measuring means.

Moreover, according to the present invention, there is provided an image forming apparatus for forming a latent image on an image carrying member, comprising: a developing roller for forming a developer image corresponding to the latent image on the image carrying member; a developer supplying roller, at least a surface of which is constituted by a resilient member contacting with the developing roller for supplying the developer to the developing roller; image transfer means for transferring the developer image formed on the image carrying member to a medium on which a visual image is being formed; voltage applying means for applying to the developer supplying roller at least one of first and second bias voltages having a value for generating a predetermined voltage difference between the developing roller and the developer supplying roller, the second bias voltage having an absolute value larger than that of the first bias voltage; first measuring means for counting a number of medium on which developer images are transferred; second measuring means for measuring a surface potential of the developer supplying roller; third measuring means for measuring a developing density of the developer image formed on the image carrying member; means for setting one of the first to third measuring means operable; and means for changing the first bias voltage applied by the voltage applying means to the second bias voltage to generate a predetermined potential difference between the developer supplying roller and the developing roller in accordance with a measuring result of one of the first to third measuring means set by the setting means.

Stable supply of a developer can be ensured for a long period of time by variably controlling the bias voltage applied to the developer supply roller in accordance with at least changes in developer supply function (e.g., changes in physical properties of the developer supply roller) of the developer supply roller. In addition, since the reproduction rate with respect to solid images can be stabilized, excellent states of solid images with a small decrease in density can be maintained for a long period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 22 is a chart showing changes in characteristics of the toner supply roller;

FIG. 23 is a chart showing the relationship between the print count and the toner supplying bias voltage;

FIG. 24 is a chart showing the relationship between the solid pattern reproduction rates and the toner conveying rates in an initial period and after printing of 10,000 paper sheets is completed;

DETAILED DESCRIPTION OF THE PREFERRED EMBODIMENTS

An embodiment of the present invention will be described below with reference to the accompanying drawings.

Figure 1:
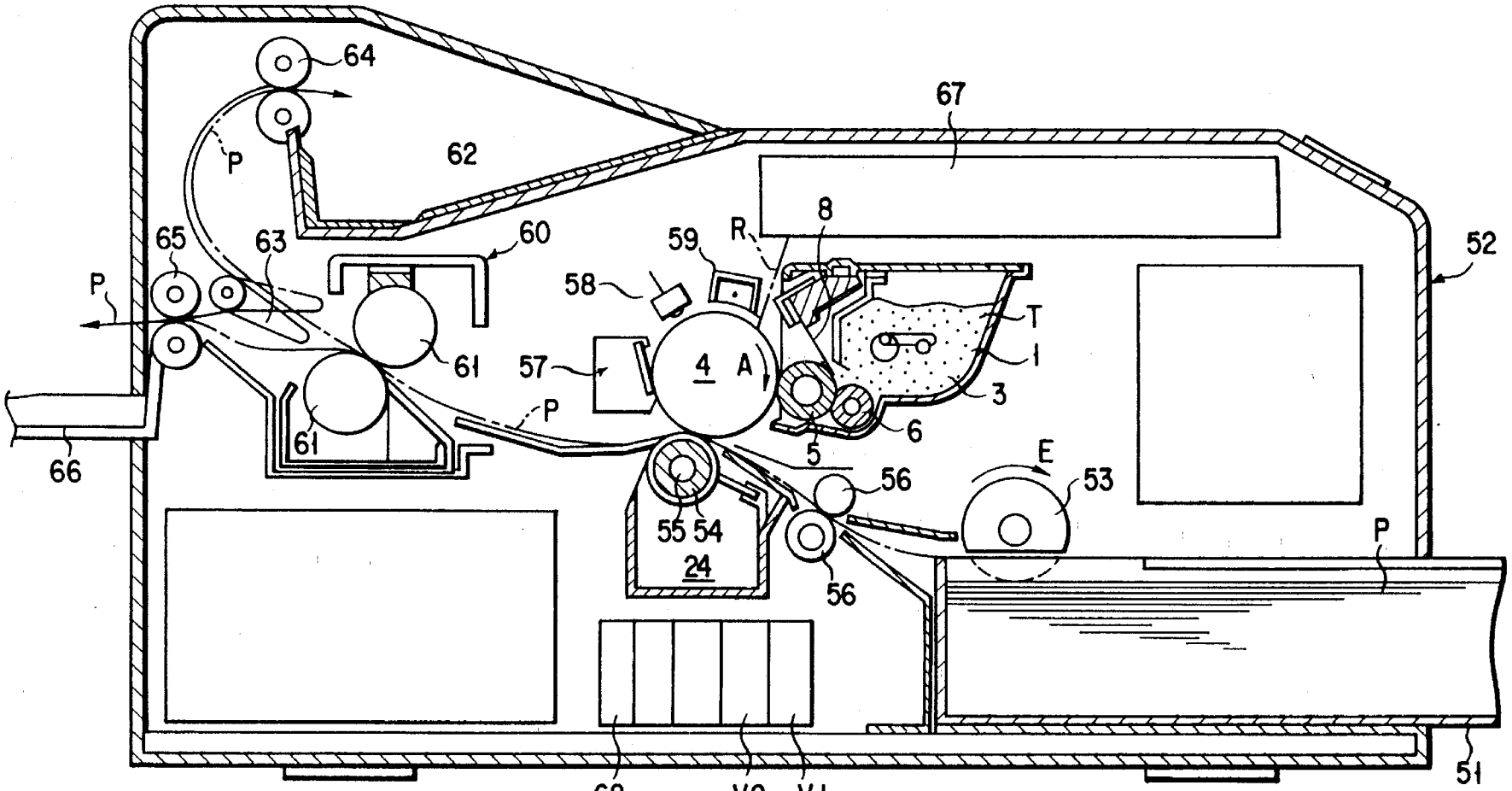
FIG. 1 shows a cross-section view of an image forming apparatus including a developing apparatus of a one-component developer system according to the present invention.

FIG. 1 shows a laser printer as an image forming apparatus for forming images on a printing paper P stored in a paper storage 51 provided in a housing 52. A paper P taken out from the paper storage 51 by means of a feeding roller 53 is conveyed to an image transfer section 24 having a transfer roller 54 with a metal shaft 55 via conveying rollers 56. At the transfer section 24, a developed toner image provided on a surface of an image carrying drum 4 is transferred to the printing paper P at a developing apparatus housed in a developing apparatus main body 1. A toner cleaner 57, a discharging lamp 58, a charger 59 are mounted along the peripheral portion of the image carrying drum 4 together with the developing apparatus main body 1 in the order mentioned to form an image forming section. The structure and function of the image forming section will be described later.

The printing paper P having the toner image formed on one surface thereof is conveyed from the transfer section 24 to an image fixing section 60 having fixing rollers 61. The printing paper P having the toner image fixed by the fixing section 60 is further conveyed to printed paper storage section 62 via a storage selection gate 63 and output rollers 64 or to printed paper storage section 66 via the gate 63 and output rollers 65. The storage section 62 is provided at an upper portion of the housing 52 of the image forming apparatus and the storage section 66 is provided at one side of the housing 52.

An image exposure apparatus 67 is provided at an upper portion of the developing apparatus main body 1 mounted in the housing 52. The image exposure apparatus 67 radiates a laser beam R to the surface of the image carrying drum 4 at an exposing portion provided between the charger 59 and the developing apparatus. The intensity of the laser beam R is modulated in accordance with image data supplied from a control section 68 including a CPU 28 as shown in FIG. 3 (described later). The control section 68 receives the image data from an external host apparatus or forms predetermined image data such as elongated strip image data to be used in one embodiment of the present invention. The use of the elongated strip image data will be described later. Reference characters V1 and V2 denote power supply sections for supplying predetermined electric power the the various sections in the image forming apparatus housed in the housing 52 including DC bias voltage sources 16 and 18 as shown in FIG. 2.

Now, a developing apparatus of an embodiment according to the present invention composed as a one-component developer system will be described here.

Figure 2:
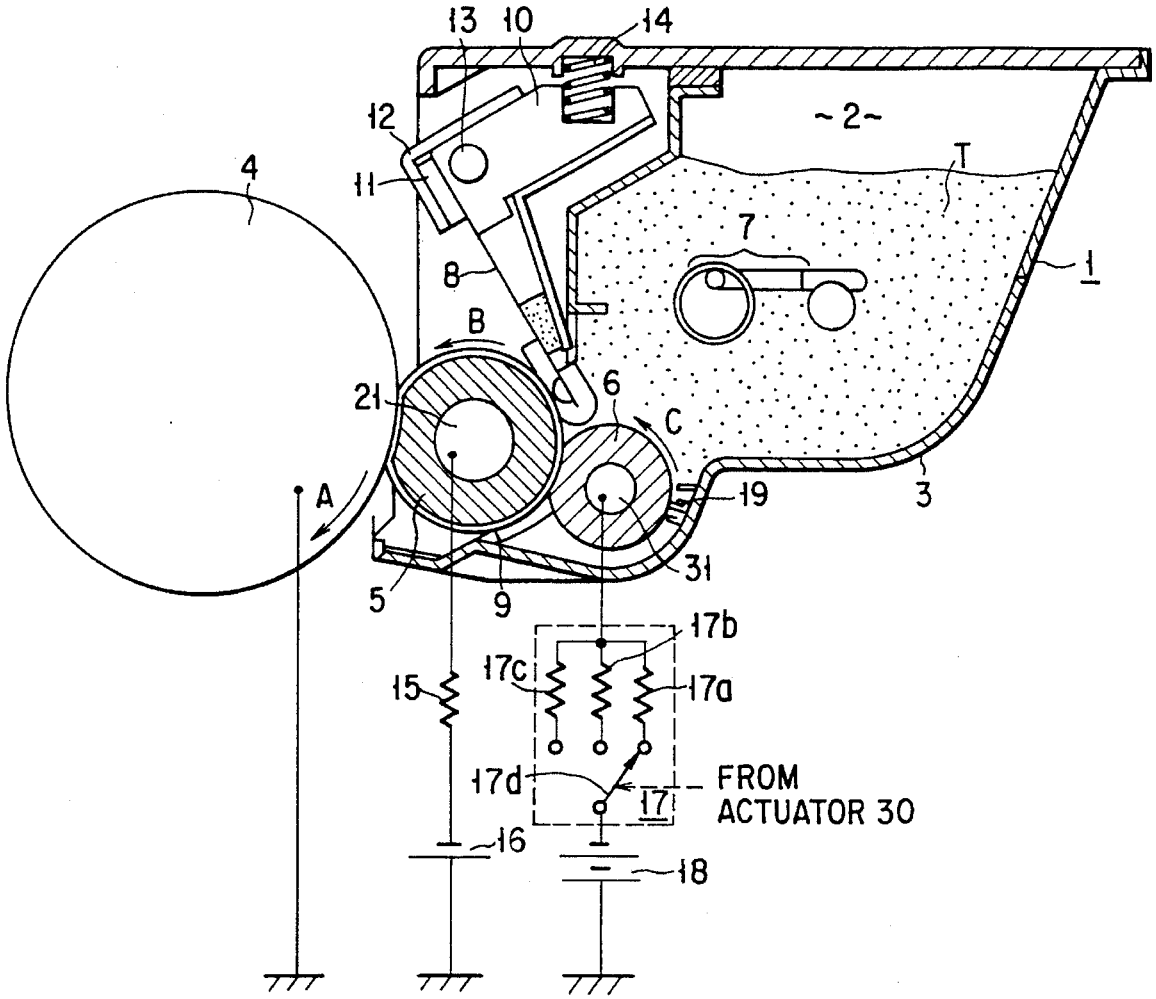
FIG. 2 shows a cross-sectional view of a developing apparatus of a one-component developer system according to one embodiment of the present invention.
Figure 3:
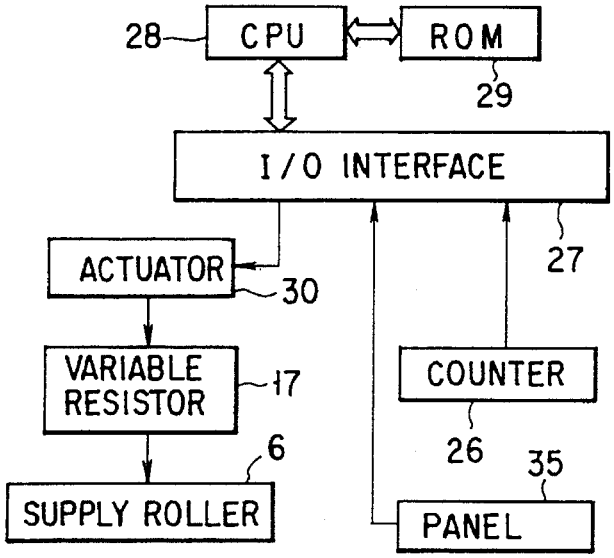
FIG. 3 shows a schematic block diagram of a control section used in connection with the arrangement shown in FIG. 2.

FIG. 2 shows a developing apparatus of the one-component developer system used in the laser printer according to this embodiment. Referring to FIG. 1, the developing apparatus main body 1 integrally has a toner hopper 3 with a toner storage portion 2 formed therein. The toner storage portion 2 serves to store a non-magnetic toner T as a one-component developer. The developing apparatus main body 1 has an opening portion formed at a position opposite to a photosensitive drum 4 as the image carrier. A developing roller 5 is arranged near the opening portion to be in resilient contact with the photosensitive drum 4 with a certain nip width upon deformation. At the contact portion, the developing roller 5 is rotated in the same direction as the rotational direction (indicated by an arrow A) of the photosensitive drum 4, i.e., the counterclockwise direction (indicated by an arrow B).

A toner supply roller 6 is disposed in a bottom portion of the toner storage portion 2. The toner supply roller 6 serves as a developer supply roller for supplying the toner T, stored in the toner storage portion 2, to the developing roller 5. The toner supply roller 6 is in contact with the developing roller 5 with a predetermined bite amount. In this embodiment, the bite amount is set to be 0.5 mm. However, this value can be changed as needed in accordance with an increase in torque of the developing unit or a toner supplying bias (to be described later).

The toner supply roller 6 is rotated in the same direction as the rotational direction (indicated by an arrow C) of the developing roller 5 to extract the toner T from the toner storage portion 2, at a lower portion of the developing apparatus main body 1, and supply it to the developing roller 5. A mixer 7 is disposed in the toner storage portion 2 to agitate the toner T.

A blade 8 is arranged above the developing roller 5 in the developing apparatus main body 1 to regulate the amount of the toner conveyed by the developing roller 5 so as to form a thin layer of the toner T on the surface of the developing roller 5. A recovery blade (e.g., a Myler film) 9 is arranged below the developing roller 5 to be in contact therewith.

The blade 8 is held by a blade holder 10, a spacer 11, and a blade holder 12 to rotate about a flucrum or a rotating shaft, 13. In addition, the blade 8 is pressed against the surface of the developing roller 5 by the rotating shaft 13 of the blade holder 10 and one or more spring members 14 for pressing.

Since the spring constant of the spring member 14 is smaller than that of the thin leaf spring member of the blade 8, almost no change in pressing amount occurs even if the contact portion of the blade 8 wears. Therefore, a stable toner layer forming ability can be maintained for a long period of time. In this embodiment, the pressing force of the blade 8 against the developing roller 5 is about 50 g/cm. Note that the pressing force can be changed as needed by changing the material for the thin leaf spring member.

A developing bias power supply 16 is connected to the developing roller 5 via a protection resistor 15 having a resistance of, e.g., 100 kΩ to 50 MΩ. A predetermined developing bias voltage is applied from this power supply 16 to the developing roller 5.

A toner supplying bias power supply 18 is connected to the toner supply roller 6 via a variable resistor 17 acting as a transformer. A predetermined toner supplying bias voltage is applied from the power supply 18 to the toner supply roller 6.

For example, the transformer 17 is designed to selectively switch the toner supplying bias voltage by switching three resistors 17*a*, 17*b*, and 17*c* having different resistance values through a switch 17*d*.

In the above-described arrangement, the toner T in the toner storage portion 2 is supplied to the toner supply roller 6 while being agitated by the mixer 7, and the toner T is supplied to the developing roller 5 by the toner supply roller 6. The toner T supplied onto the developing roller 5 by the toner supply roller 6 is triboelectrified between the toner supply roller 6 and the developing roller 5, and is conveyed onto the blade 8 by an electrostatic force and a physical force.

The toner T on the developing roller 5 is charged again by triboelectrification while the amount of the toner T passing the blade 8 is regulated by the blade 8. After the toner T passes the blade 8, the toner is sufficiently charged, and a uniform toner layer is formed. In this embodiment, since reversal development is performed by using the negatively charged, organic, photosensitive drum 4, the toner T is negatively charged.

In this embodiment, the surface potential of the photosensitive drum 4 is set to be −500 volts (to be simply referred to as v hereinafter), and the developing bias voltage is set to be −200 V. The bias voltage is applied to the metal shaft 21 of the developing roller 5 via the protection resistor 15. In this case, the developing roller 5 and the photosensitive drum 4 are pressed by a constant load pressing scheme such that the rollers are brought into contact with each other with a contact width (development nip) of about 2.0 mm. Note that the optimal value of the development nip falls within the range of 0.5 mm to 4.0 mm. With the development nip exceeding 4.0 mm, so-called fogging occurs on a background portion on the photosensitive drum 4.

The residual toner which is not consumed in developing an image and passing through the development nip returns to the toner storage portion 2 through the recovery blade 9.

The developing roller 5 used in the embodiment will be described next. As described above, the developing apparatus of the embodiment is characterized in that the developing roller 5 is in contact with the photosensitive drum 4. For this reason, a resilient roller must be used as the developing roller 5. In addition, in order to stably convey a toner to a development position, the developing roller 5 must be designed to prevent the toner from adhering to the roller surface. For this reason, the developing roller 5 needs to have the following characteristics. The roller must have a proper resilience, a smooth surface, and a proper resistance value between the metal shaft 21 and the roller surface.

Figure 9:
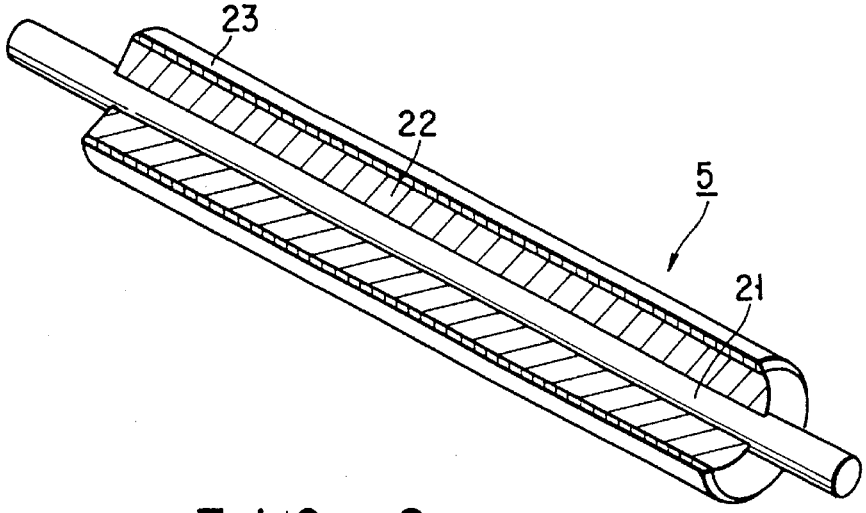
FIG. 9 is a partially cutaway perspective view of the arrangement of a developing roller.

In order to satisfy these requirements, for example, as shown in FIG. 9, this embodiment uses the developing roller 5 obtained by stacking two layers, i.e., a resilient layer 22 consisting of a conductive rubber and a surface conductive layer 23, around a metal shaft 21, and a developing bias voltage is applied to the metal shaft 21. The rubber hardness of the resilient layer 22 preferably falls within the range of 20° to 30°, and the rubber hardness of the overall layer structure including the surface conductive layer 23 preferably falls within the range of 25° to 40°. The smoothness of the roller surface is preferably set such that the surface roughness is 5 μmRz or less, and the friction coefficient with respect to a print paper sheet is 1.0 or less.

Figure 10:
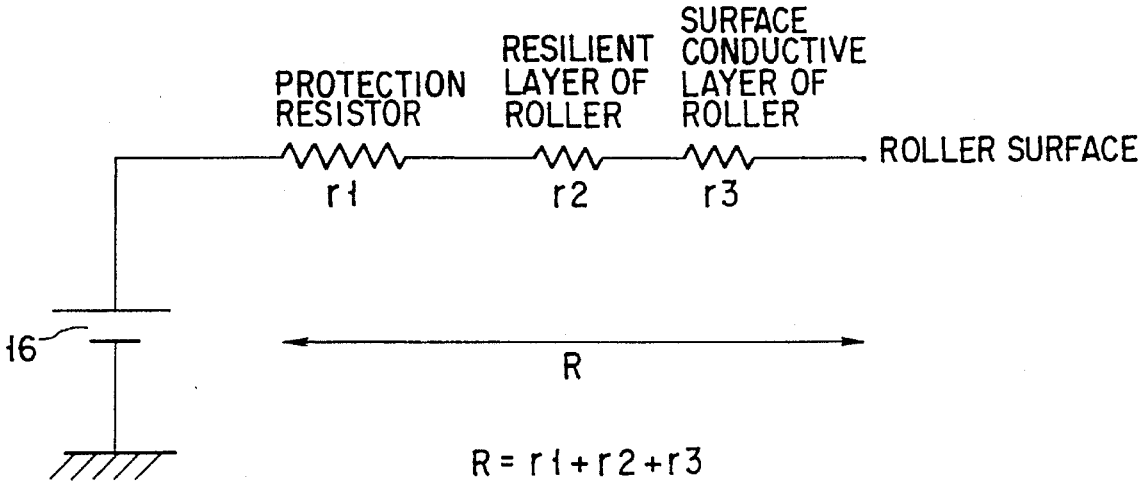
FIG. 10 is a circuit diagram for explaining the resistance value between a developing bias power supply and the surface of the developing roller.

The resistance value between the surface of the developing roller 5 and the developing bias power supply 16 will be described below. As shown in FIG. 10, a resistance value R between the developing bias power supply 16 and the surface of the developing roller 5 is the sum of resistance values r1 to r3 of series-connected resistors. Note that the resistance value r1 is that of the protection resistor 15; the resistance value r2 is that of the resilient layer 22 of the developing roller 5; and the resistance value r3 is that of the surface conductive layer 23 of the developing roller 5.

Figure 11:
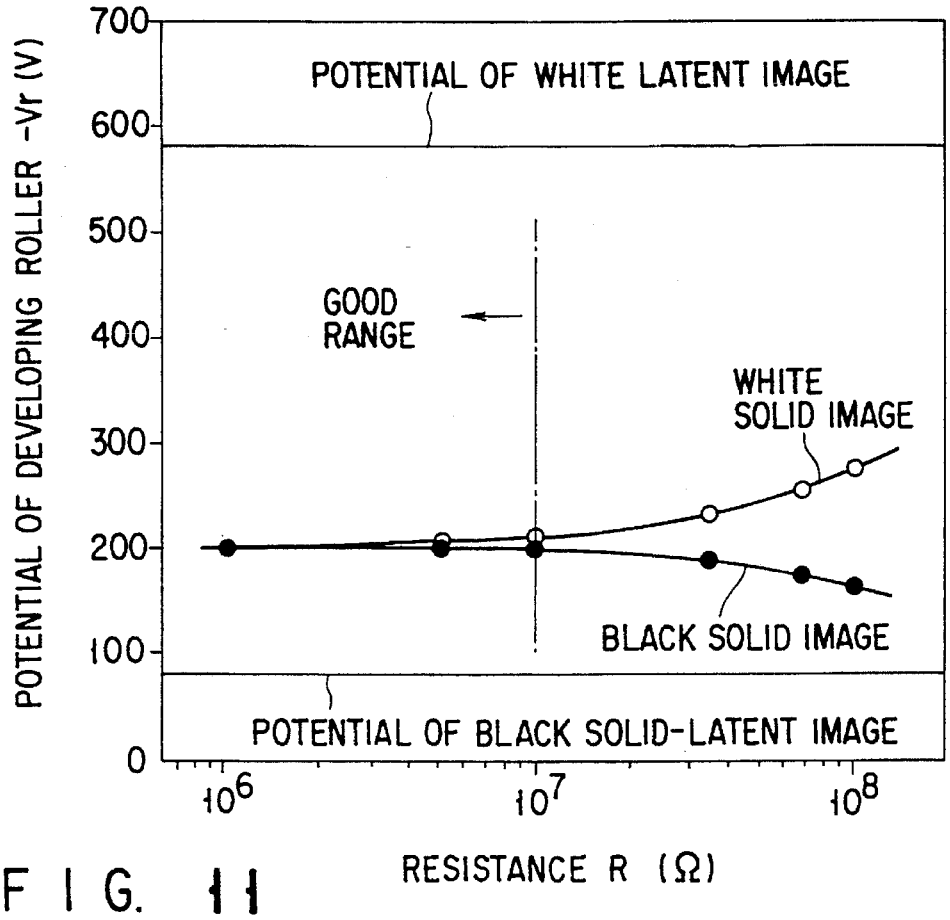
FIG. 11 is a graph showing the relationship between the surface potential of the developing roller and the resistance value between the developing bias power supply and the surface of the developing roller.

An experiment was performed to examine the correlation between the surface potential and resistance value of the developing roller 5, and the surface potential of the photosensitive drum 4, with the resistance values r1 to r3 being changed. FIG. 11 shows how the surface potential of the developing roller 5 changes with the resistance value R when the surface potential of the photosensitive drum 4 is set to be −580 V (corresponding to a white background) and −70 V (corresponding to a black background). As is apparent from FIG. 11, when the resistance value R is $10^7$ Ω or more, the surface potential of the developing roller 5 differs depending on whether white solid image printing or black solid image printing is performed.

The surface potential of the developing roller 5 tends to approach a latent image potential as the resistance value R increases. For this reason, if a character is printed in a white background, thickening of the character occurs because the effective bias potential increases owing to the influence of a surrounding white latent image. Such a tendency becomes conspicuous when the resistance value R is $10^8$ Ω or more. Therefore, the resistance value is preferably set to be $10^8$ Ω or less, more preferably $10^7$ or less. In the embodiment, r2+r3=100 kΩ, and r1=5 MΩ, so that R=$5.1\times10^6$ Ω.

For the above-described reasons, in forming the developing roller 5 in the embodiment, a conductive urethane rubber having a rubber hardness of about 30° and a resistance value of about $5\times10^3$ Ω.cm was used as the resilient layer 22, and a conductive polyurethane coating material (available from Nihon Miractran K.K.; trade name: "Supalex Z313"; resistance value: $5\times10^3$ Ω) was used as the surface conductive layer 23, which was formed to have a thickness of about 30 μm by tipping coating. As a result, the rubber hardness (JAS-A) of the formed developing roller 5 was about 35°, and the resistance value between the metal shaft 21 and the roller surface was about 100 kΩ.

As described above, since the surface of the developing roller 5 serves to charge a toner in cooperation with the blade 8 by triboelectrification, it is preferable that the charging property of the surface conductive layer 23 of the developing roller 5 be opposite (positive in the embodiment) to that of a toner. When the charging property of the surface conductive layer 23 (Supalex) used in the embodiment was measured, it was found that the layer had a charged amount of 0 nc, i.e., a neutral charging property (capable of being charged to either the positive side or the negative side).

Figure 12:
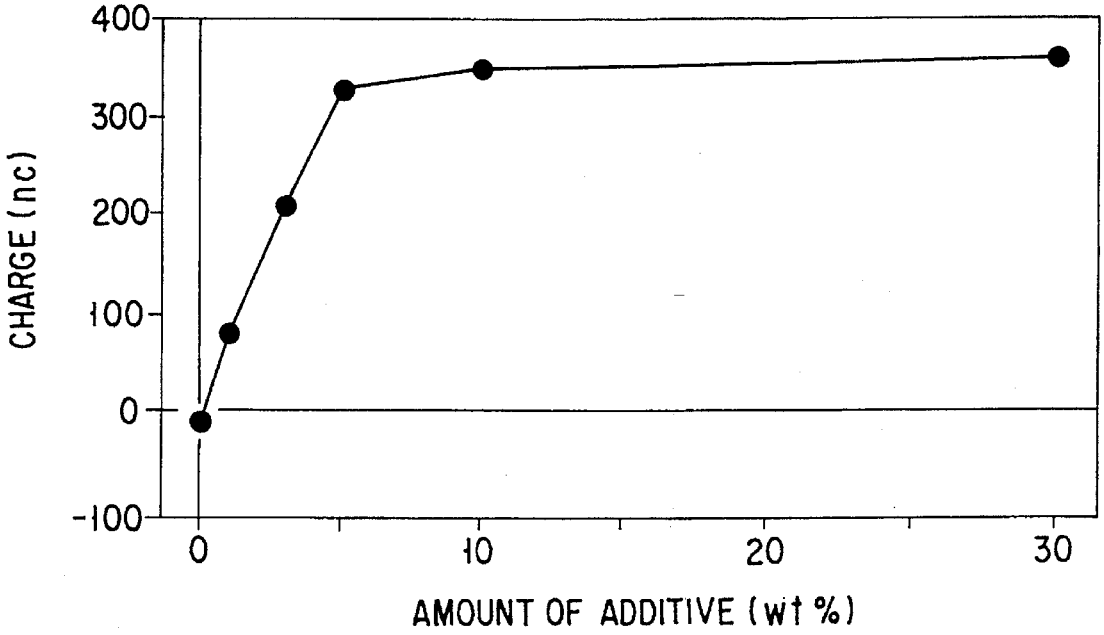
FIG. 12 is a graph showing the relationship between the amount of an additive (charging control agent) and the charged amount.

In order to shift the charging property in the positive direction, a charging control agent (a resin-based charging control agent available from Du Pont de Nemours, E. I., Co.; trade name: "PC-100") was added. FIG. 12 shows the result. As is apparent from FIG. 12, the charged amount becomes stable upon addition of the charging control agent by an amount corresponding to 5% (wt. %) or more of the solid content of the surface conductive layer 23. Therefore, in the embodiment, the charging control agent was added by an amount corresponding to 5 wt % of the solid content of the Supalex used as the surface conductive layer 23.

The toner supply roller 6 used in the embodiment will be described next. As described above, since the toner supply roller 6 needs to properly bite into the developing roller 5 and stably supply a toner, a foamed elastomer is preferably used for the roller. In addition, since a bias voltage is applied to the toner supply roller 6 via the metal shaft 31, the roller 6 preferably has conductivity.

Figure 13:
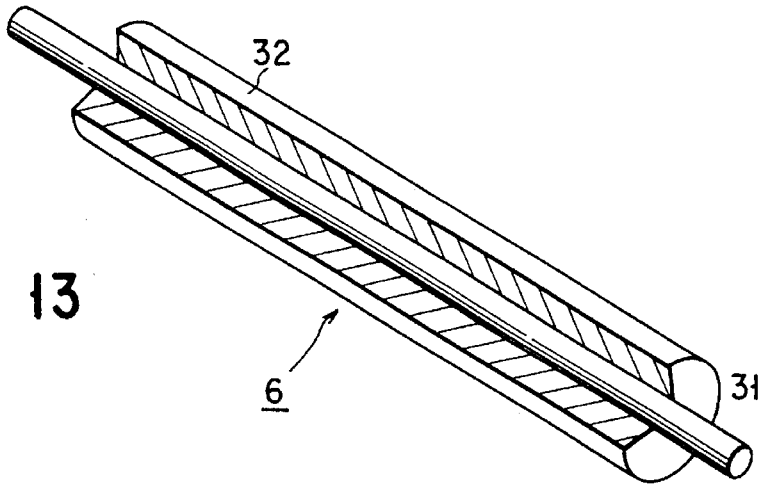
FIG. 13 is a partially cutaway perspective view of the arrangement of a toner supply roller.

In the embodiment, therefore, for example, as shown in FIG. 13, a conductive urethane foam (available from BRIDGESTONE CORP.; trade name: "EPT-51") 32 is formed around the metal shaft 31 to form a roller 6 having an outer diameter of about 12.5 mm, and a bias voltage is applied to the metal shaft 31.

With the above arrangement, a toner supply roller 6 having a resistance value of about 50 MΩ between the metal shaft 31 and the roller surface, and a hardness (ASKER-C) of about 40°, is obtained.

The developing apparatus having the above-described arrangement was assembled in, e.g., a laser printer TN-7300 available from TOSHIBA CORP as shown in FIG. 1, and a test was conducted. This printer has a process speed of 72 mm/sec and uses a negative charging type OPC drum having a diameter of 60 mm as the photosensitive drum 4. On the developing apparatus side, the peripheral speed was set to be 144 mm/sec (the developing roller 5 was rotated at a speed twice that of the photosensitive drum 4). Since the relationship between the bias voltages of the developing roller 5 and the toner supply roller 6 has been described above, a description thereof will be omitted here. Note, however, that a bias voltage having the same potential as that of the developing bias voltage is also applied to the toner supply roller 6 to prevent clogging with a toner.

In the test, a pulverized negative toner obtained by dispersing carbon, wax, and a charging control agent in a polyester resin was used. Note that if the carbon content of the toner is large, toner filming on the developing roller 5 tends to occur. For this reason, the carbon content of the toner was set to be 2.5%, which is smaller than that of a toner generally used.

In the test apparatus having the above-described arrangement, printing was actually performed, and the states of images were observed with regard to character portions and small solid portions (batch portions), neither toner scattering nor blurring on trailing end portions occurred, thus obtaining good images. With regard to solid images in the traveling direction of a print paper sheet, image trailing end portions exhibited decreases in density. Such a phenomenon occurs for the following reason. In a development system in which the developing roller 5 has no magnetic pole, and a toner is conveyed without using any magnetism, when solid printing is performed, the amount of the toner conveyed becomes insufficient, and the toner amount required for development cannot be ensured. This is a drawback in a so-called non-magnetic one-component developer system. Note that the toner conveying rate in solid printing was defined as follows:

conveying rate Rb=De/Ds×100

Ds: image density of leading end of solid portion

De: image density of trailing end of solid portion

Figure 14:
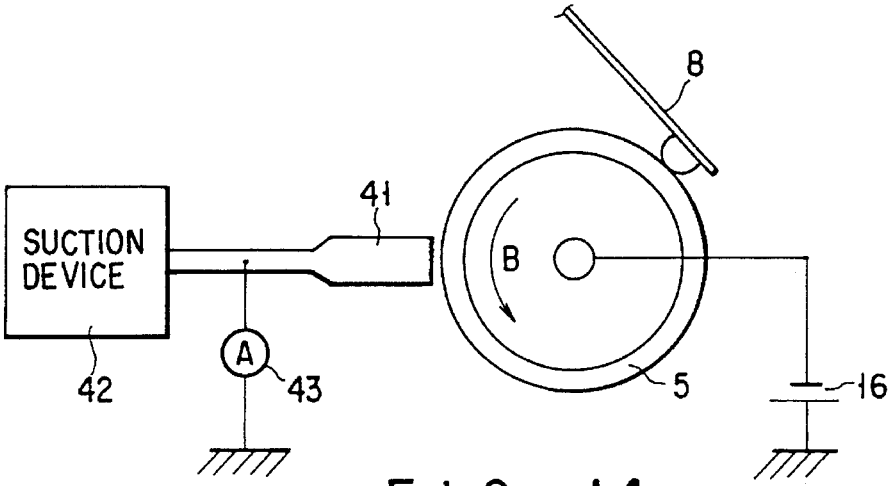
FIG. 14 is a schematic view of a suction type charged amount measuring device.

When the conveying rate became 80% or less, the variation in image density increased, and the resultant image was determined as a defective image. A method of measuring the amount of the toner conveyed will be described below. FIG. 14 illustrates the schematic arrangement of a measuring device. In this measuring method, a suction attachment (opening area of 20 $cm^2$) 41 is arranged to oppose the developing roller 5 on which a toner layer is formed, and the toner layer is drawn by a suction device 42. In accordance with a weight change=Wd1 of the developing apparatus before and after a suction operation, and a charged amount Qt1 observed by a micro ammeter 43 when a toner portion separated from the developing roller 5 passes through a Faraday gage, the toner layer amount (ml) per unit area in a steady state, and a toner charged amount (Q1) are calculated as follows:

m1=wd1/20 ($g/cm^2$)

Q1=Qt1/Wd (μc/g)

Subsequently, in order to evaluate the rising characteristics of charging and the conveying rate, a charged amount and a toner amount per unit area were measured when a suction operation was continuously performed with respect to the entire surface of the developing roller 5. In the measurement, a suction operation was continuously performed by an amount corresponding to 10 rotations of the developing roller 5 (corresponding to almost the A4 vertical size) while the developing roller 5 was rotated by the device shown in FIG. 14. If the drawn toner amount and the charged amount in this case are represented by Wd2 and Qt2, respectively, the toner amount (m2) per unit area and the toner charged amount (Q2) in the continuous suction operation can be calculated as follows:

m2=Wd2/(S×10) ($g/cm^2$)

Q2=Qt2/Wd (μc/g)

In addition, a rising rate Rq of charging and a toner conveying rate Rm are defined as follows:

Rm=m2/m1×100 (%)

Rq=Q2/Q1×100 (%)

According to the above equations, when the toner conveying rate Rm is 100%, no decrease in image density occurs on the trailing end portion of a solid portion even if solid development is performed in the above-described manner. However, in the development system in which the developing roller 5 has no magnetic pole therein, and a toner is conveyed by using the image force and physical adhesive force of the toner, the ability to convey the toner is inferior to that in other development systems in which the toner is conveyed by using magnetism. That is, it is difficult to set the toner conveying rate Rm to be 100%. In the developing apparatus of the embodiment, when the toner layer amount ml and the toner conveying rate Rm were measured and calculated, with the blade pressing force being set to be 50 g/cm, it was found that the toner layer amount ml was about 0.59 $mg/cm^2$, and the toner conveying rate Rm was about 52%.

The following two means may be considered as means for increasing the toner conveying rate Rm: (1) decreasing the development efficiency; and (2) increasing the electrical toner conveying force by setting a potential difference between the developing roller 5 and the toner supply roller 6. In the method (1) of decreasing the development efficiency, when the developing efficiency was set to be 85% or less, the image density and the toner conveying rate became 1.2 or more and 80% or more, respectively, thus obtaining a good image.

In some continuous printing tests, however, filming of carbon in a toner occurred on the surface of the developing roller 5, resulting in an increase in fogging rate on the photosensitive drum 4 or toner omission. The following was considered to be the reason for such a phenomenon. Since the developing efficiency was decreased, toner particles which were not used for development were frequently charged by the blade 8 to increase the image force with respect to the developing roller 5. As a result, it became difficult to peel the toner particles by means of the toner supply roller 6.

For this reason, the method of decreasing the development efficiency was abandoned for the time being, and the method (2) of increasing the toner conveying force by setting a potential difference between the developing roller 5 and the toner supply roller 6 was examined.

Figure 15:
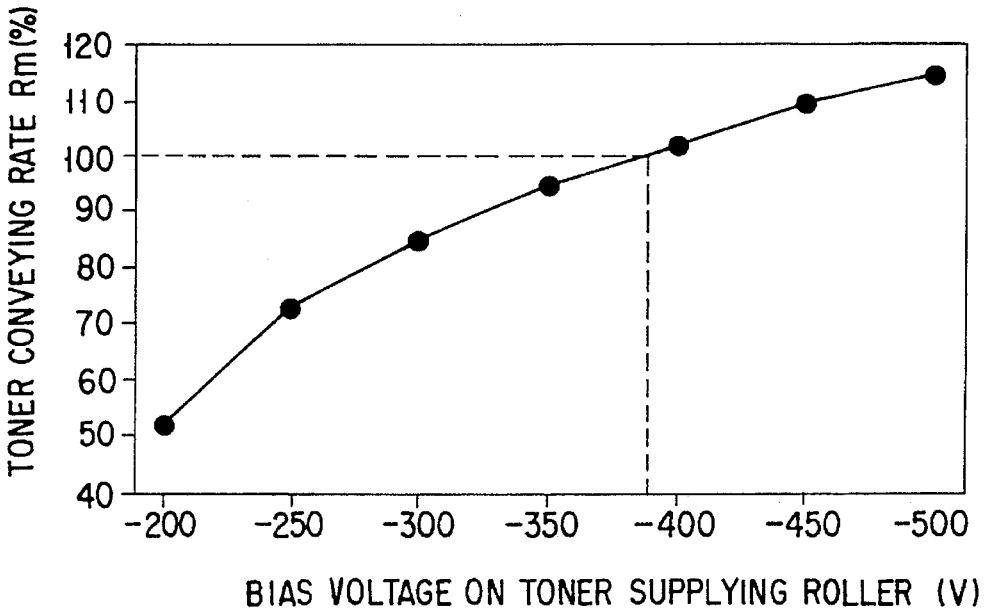
FIG. 15 is a graph showing changes in toner conveying rate as a function of the toner supplying bias voltage.

FIG. 15 shows changes in toner conveying rate when a bias voltage (to be sometimes referred to as a toner supplying bias voltage hereinafter) applied to the toner supply roller 6 is increased from the same potential as that of the developing roller 5 in the negative direction. Measurement was performed by the charged amount measuring device shown in FIG. 14 as the toner supplying bias voltage was changed, 50 v at a time, from −200 V to −500 V. As a result, a toner supplying bias voltage of about −380 V or more was required to set the conveying rate to be 100% or more.

Figure 16:
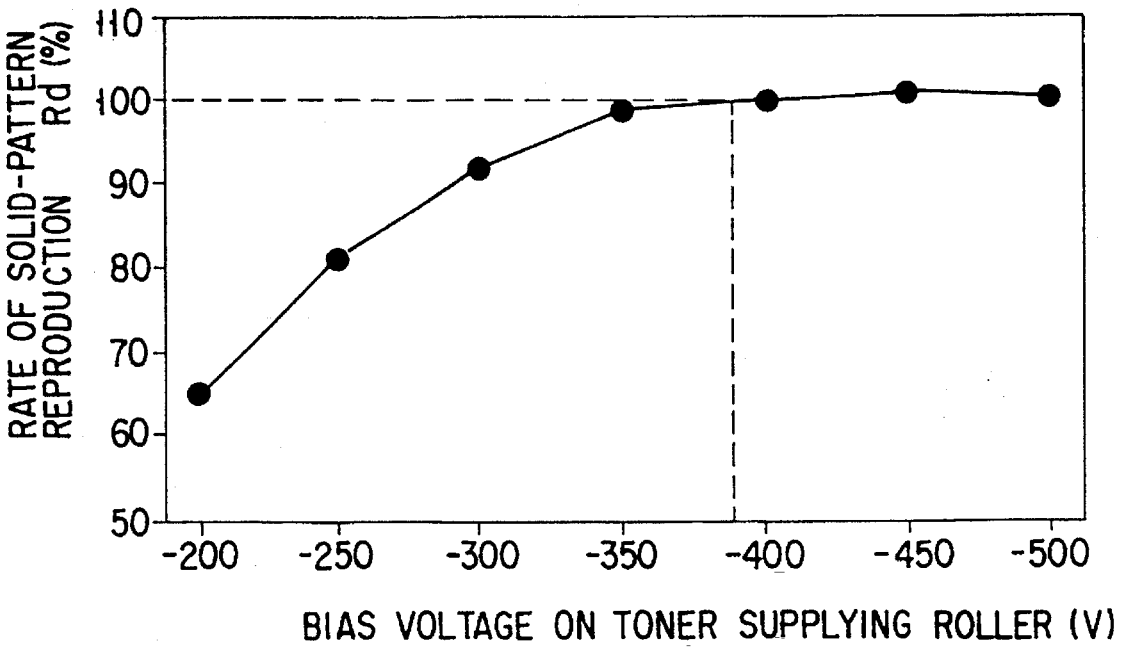
FIG. 16 is a graph showing the relationship between the toner supplying bias voltage and the solid pattern reproduction rate.
Figure 17:
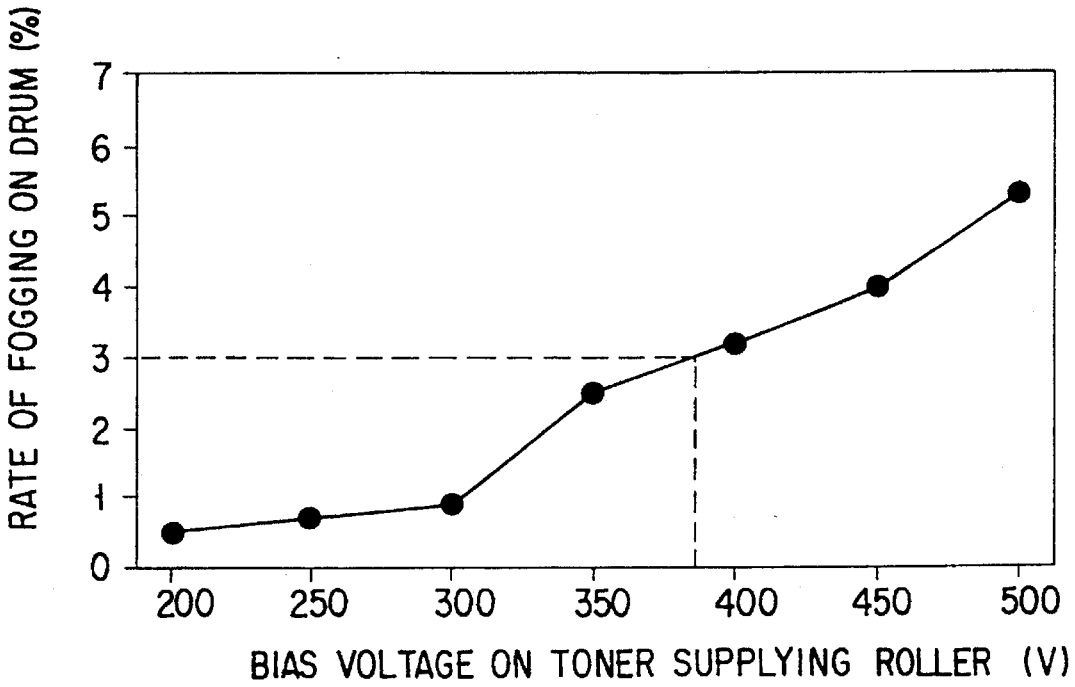
FIG. 17 is a graph showing the relationship between the toner supplying bias voltage and the fogging rate on a photosensitive drum.

By using the above-mentioned test apparatus (TN-7300 available from TOSHIBA CORP.), the solid pattern reproduction rate and the fogging rate on the photosensitive drum 4 were measured under the above-described condition of the toner supplying bias voltage (other conditions were the same as those described above). FIGS. 16 and 17 show the results. When a toner supplying bias voltage of −380 V, based on FIG. 15, was applied, the conveying rate for a solid portion became 100%. It was thus confirmed that a toner supply bias voltage was effective in preventing a decrease in density of a trailing end of a solid portion.

Referring to FIG. 17, however, when the toner supplying bias voltage is −380 V, the fogging rate on the photosensitive drum 4 is twice or more that set when the toner supplying bias voltage is −200 V. That is, with regard to the fogging rate on the photosensitive drum 4, the lower the toner supplying bias voltage is, the better the result is. In a printer with a cleaner, which is designed to recover the residual toner on the photosensitive drum 4 after a transfer operation, since the toner recovered by the cleaner is treated as a waste, the fogging rate on the photosensitive drum 4 is preferably minimized.

According to FIGS. 16 and 17, a toner supplying bias voltage of −300 V is set as a standard voltage which is considered to be a good condition in either case. When the toner supplying bias voltage is set to be −300 V, the solid pattern reproduction rate is about 90%, and the fogging rate on the photosensitive drum 4 is about 0.8%. As is apparent from the above description, since an image with a solid pattern reproduction rate of 80% or more can be determined as a good image, this condition of −300 V is an optimal condition.

Note that it is essential that the surfaces of the developing roller 5 and the toner supply roller 6 have proper resistance values, because bias voltages having difference potentials are applied to the developing roller 5 and the toner supply roller 6.

Figure 18:
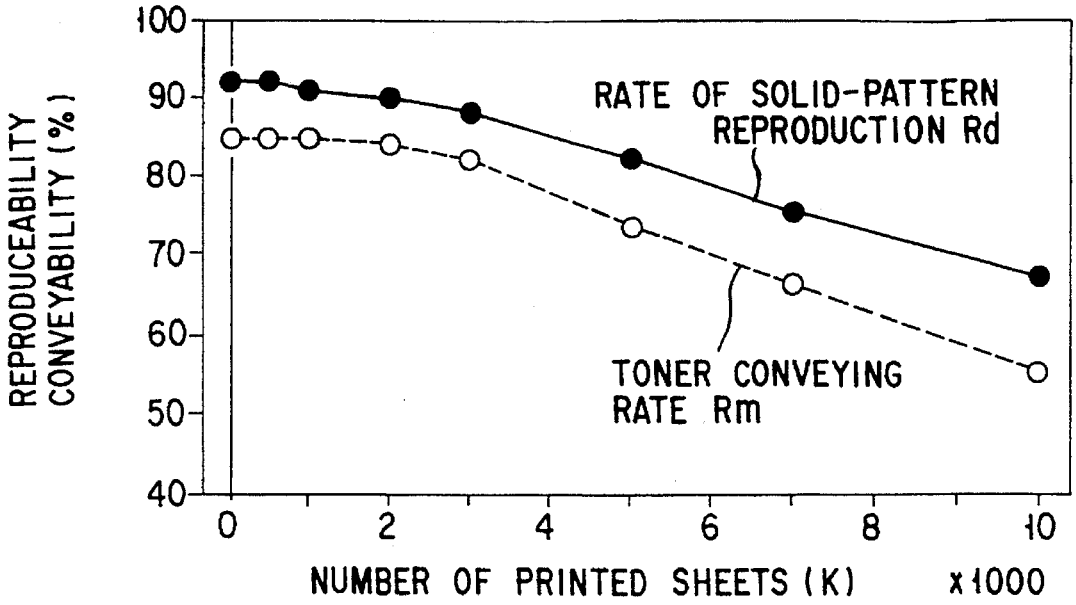
FIG. 18 is a graph showing the relationship between the print count, the solid pattern reproduction rate, and the toner conveying rate.

Under the condition that a toner supplying bias voltage of −300 V was applied to the toner supply roller 6, a printing test of 10,000 paper sheets was performed. FIG. 18 shows changes in solid pattern reproduction rate Rd and toner conveying rate Rm as a function of the print count. As is apparent from FIG. 18, the solid pattern reproduction rate Rd and the toner conveying rate Rm tend to decrease as the print count becomes about 2,000. The solid pattern reproduction rate Rd= 80%, at which a solid image is determined as a defective image, is maintained up to a print count of about 5,000. Thereafter, the effect of the toner supplying bias voltage cannot be obtained.

Figure 19:
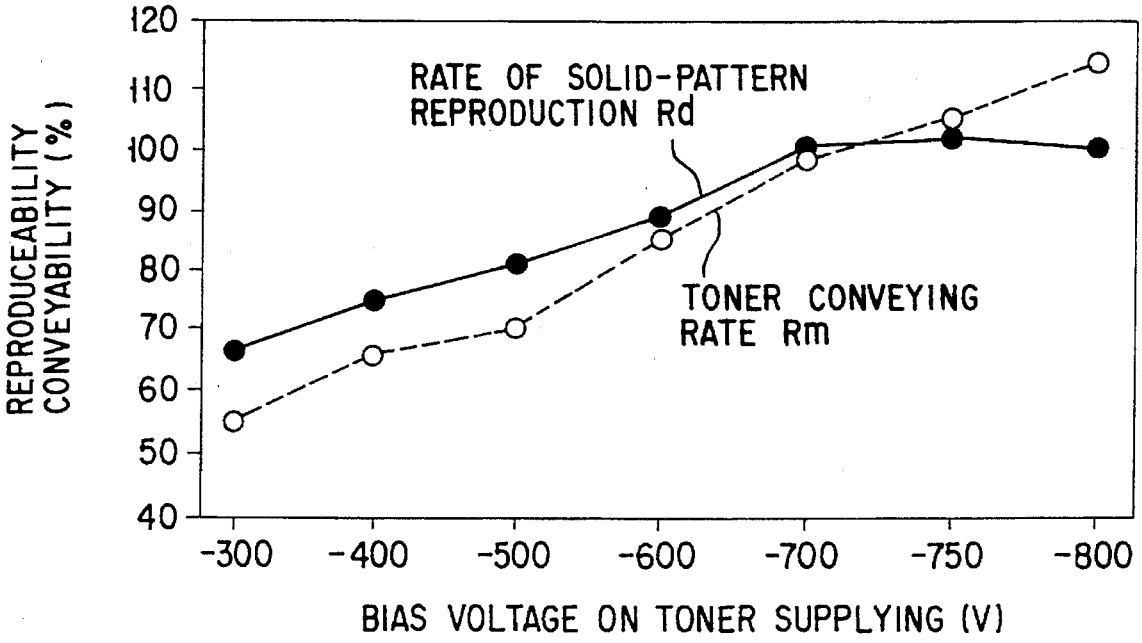
FIG. 19 is a graph showing the relationship between the toner supplying bias voltage, the solid pattern reproduction rate, and the toner conveying rate.

When the toner supplying bias voltage was changed after printing of 10,000 paper sheets was completed, it was confirmed that the solid pattern reproduction rate Rd and the toner conveying rate Rm increased. FIG. 19 shows the result. It was found from this result that in order to obtain a sufficiently high solid pattern reproduction rate (≧80%) at the end of printing of 10,000 paper sheets, a toner supplying bias voltage of −500 V or more was required, which voltage was different from that set as the initial condition.

Although not shown, the fogging rate on the photosensitive drum 4 was about 5% when the toner supplying bias voltage was −500 V. It was confirmed from the above results that a decrease in the solid pattern reproduction rate Rd during the service life of the toner supply roller 6 was prevented by increasing the toner supplying bias voltage.

The causes which decreased the solid pattern reproduction rate Rd as the service life came closer to its end were checked. When the developing apparatus was checked upon completion of a printing test of 10,000 paper sheets, the surface of the toner supply roller 6 was found to have hardened. Therefore, a careful consideration was given to changes in quality of the toner supply roller 6. FIG. 22 shows changes in major characteristics of the toner supply roller 6 at the end of printing of 10,000 paper sheets.

This result reveals that as the service life of the toner supply roller 6 came closer to its end, the following problems were posed: (1) a reduction in bite amount (nip) with respect to the developing roller 5; and (2) a reduction in effect of the bias voltage with an increase in resistance value. Since a foamed elastomer (a foamed conductive urethane foam in the embodiment) is used for the toner supply roller 6, the toner permeates the roller. This is considered to be a cause of the above problems. It is expected to be difficult to use the toner supply roller 6 without changing its characteristics as the service life comes closer to its end.

It is obvious from the above results that a solid pattern reproduction rate Rd of 80% or more can be obtained, at the end of the service life corresponding to printing of 10,000 paper sheets, by changing the toner supplying bias voltage from −300 V to −500 V. If, however, a toner supplying bias voltage of −500 V or more is applied from the initial state, the fogging rate on the photosensitive drum 4 under the initial condition becomes 5% or more, increasing the fogging rate on a paper sheet in a humid environment or greatly influencing the amount of the toner consumed.

In order to satisfy these contradictory conditions, the toner supplying bias voltage is changed in accordance with the number of times of image formation with respect to the photosensitive drum 4, i.e., a print count. More specifically, the toner supplying bias voltage is set to be −300 V in the interval from the initial period during which the solid pattern reproduction rate Rd is kept to 80% or more to the instant at which the print count becomes 5,000. Thereafter, the toner supplying bias voltage is increased from −300 V to compensate for a decrease in solid pattern reproduction rate. With this arrangement, the solid pattern reproduction rate Rd is always kept to 80% or more, and an increase in fogging rate on the photosensitive drum 4 can be minimized.

A method of changing the bias voltage will be described next. When the toner supplying bias voltage is fixed, power supply can be performed through one transformer by using a developing bias voltage and resistor division. However, in order to change the toner supplying bias voltage, another power supply is required. A method of adjusting a voltage output from the toner supplying bias power supply 18 to a desired voltage by switching the resistors 17*a* to 17*c* in the transformer 17 in accordance with a command from a CPU seems to be simple in terms of mechanism. Note that Zener diodes may be used in place of the resistors 17*a* to 17*c*.

The following are modes associated with voltage switching timing.

(1) voltage switching is performed when the print counter detects that the print count on the printer main body side has reached a predetermined count.

(2) Voltage switching is performed when the monitored current value of the driving motor of the developing apparatus becomes a predetermined value.

(3) Voltage switching is performed such that the effective value of the toner supplying bias voltage, monitored by a bias measuring device, becomes a predetermined value.

(4) In a warm-up period or printing interval (paper interval), a solid strip pattern is formed on the photosensitive drum 4, and voltage switching is performed in accordance with a command from the CPU while the toner density on the photosensitive drum 4 is monitored by photosensors.

Of these modes, the mode (2) cannot be easily realized because it is very difficult to isolate a factor for torque variation in the developing apparatus. Cases wherein the above-mentioned modes (1), (3), and (4), except for the method (2), are applied to the printer will be sequentially described in detail below. For example, these modes (1), (3), and (4) can be switched by selecting a mode using a mode switch (described later), and supplying the corresponding information to the CPU.

The embodiment of FIG. 1 corresponds to the mode (1), and the printer includes a control section for switching the bias voltage when the print count on the printer main body side reaches a predetermined count.

FIG. 3 shows the control section 68 of the first embodiment having the structure as shown in FIG. 2. The control section 68 of FIG. 3 includes a CPU 28 and a ROM 29 connected with the CPU 28. The ROM 29 stores program data used to control the whole sections of the laser printer shown in FIG. 1 as well as data tables to be used to change the bias voltage of the toner supply roller 6 in accordance with the conditions of the laser printer as will be described later.

The number of printing operations or print count is counted by a counter 26 and the counted number data is supplied to the CPU 28 via an I/O interface 27. The switch 17*d* of the variable resistor 17 is driven by an actuator 30 which receives a driving signal from the CPU 28 via the I/O interface 27. When the actuator 30 is driven, the switch 17*d* is switched to a predetermined contact so that one of the resistors 17*a* to 17*c* is connected between the roller 6 and the voltage supply 18 to change the bias voltage of the roller 6.

The switch 17*d* can also be operated manually by an operator using a manually operable switch (not shown) provided on a panel 35 of the laser printer of FIG. 1.

Figure 20:
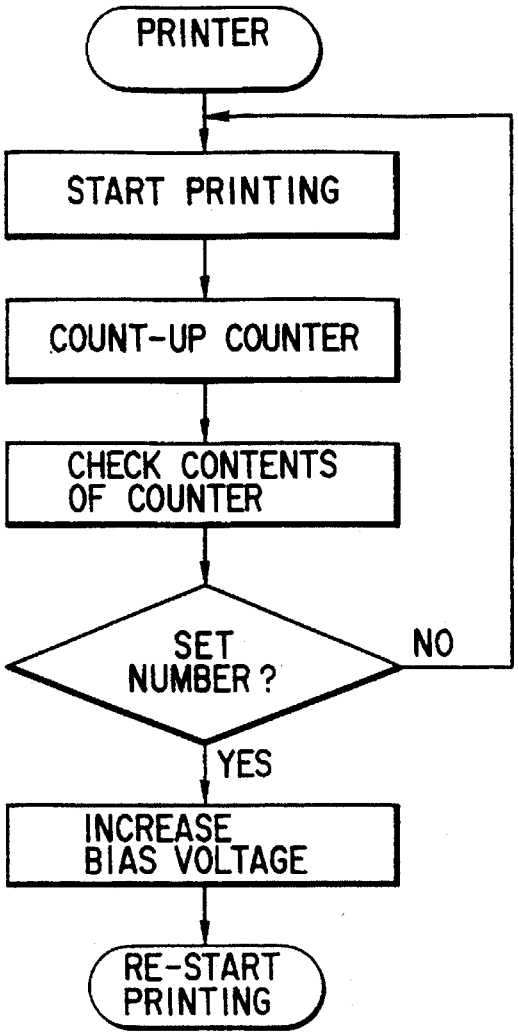
FIG. 20 is a flow chart showing the process of switching the toner supplying bias voltage when the print count reaches a predetermined count.

FIG. 20 is a flow chart showing the process of switching the toner supplying bias voltage when the print count of the counter 26 of FIG. 3 reaches a predetermined count. Every time the printer performs a printing operation, the total print count is detected by the counter 26, and the detected count is compared with a predetermined count for switching the toner supplying bias voltage, preset in the ROM 29. If it is determined from this comparison that the print count has not reached the predetermined count, printing is continued. Otherwise, as shown in FIG. 13, an automatic switching mode in which the CPU 28 automatically switches the toner supplying bias voltage. Otherwise, it is set a user switching mode in which information indicating bias voltage switching is displayed on an operation panel 35 of the printer, and a user issues a command to switch the resistors 17*a* to 17*c* to the switch actuator 30 through the operation panel 35 upon visually recognizing the display.

In the automatic switching, when the counter 26 detects that the print count has reached the predetermined count, the actuator 30 is driven by a bias voltage changing signal from the CPU 28 to control the switch 17*d* of the transformer 17 so as to switch the resistors 17*a* to 17*c*, thereby changing the bias voltage to a predetermined voltage. With this operation, no serious problems are posed even if the print count reaches the predetermined count for switching the bias voltage during a continuous printing operation.

However, in the user switching mode of allowing a user to issue a command through the operation panel 35, voltage switching may be performed during a continuous printing operation or a switching command may be neglected by the user. In consideration of these cases, in the flow chart shown in FIG. 20, for example, a means for inhibiting reception of print data if voltage switching is not performed after the completion of continuous printing corresponding to a set print count, 5000, for example, may be arranged for the former case, and a means for inhibiting reception of print data when printing of several tens paper sheets is completed after a switching command is issued may be arranged for the latter case. With these means, a stable solid pattern reproduction rate and a stable toner conveying rate can always be obtained.

Proper degrees of changes in toner supplying bias voltage with an increase in print count were checked as follows. A printing test was performed under the same conditions as those for the above-described printing test of 10,000 paper sheets. When the print count reached 5,000, at which the solid pattern reproduction rate Rd and the toner conveying rate Rm started to decrease, the toner supplying bias voltage was changed every 1,000 paper sheets afterward, and proper conditions were checked. Target values are about 90% for the solid pattern reproduction rate Rd, and about 85% for the toner conveying rate Rm. FIG. 23 shows print counts and toner supplying bias voltages required to obtain the target values.

When the toner supplying bias voltage was increased from −400 V to −600 V after the print count reached 5,000, the solid pattern reproduction rate Rd was 80% or more, at which the corresponding images could be determined as good images, even after printing of 10,000 paper sheets was completed. The fogging rate on the photosensitive drum 4 may increase when the toner supplying bias voltage is increased. Although the fogging rate slightly increased immediately after the bias voltage was changed, the value of the fogging rate itself was about 3%. It was thus confirmed that the fogging rate on the photosensitive drum 4 only slightly increased with a change in bias voltage.

According to the above results, a stable solid pattern reproduction rate and a stable toner conveying rate can always be obtained by changing the toner supplying bias voltage every time the print count reaches 1,000 (see FIG. 20) after the print count has reached 5,000.

Figure 4:
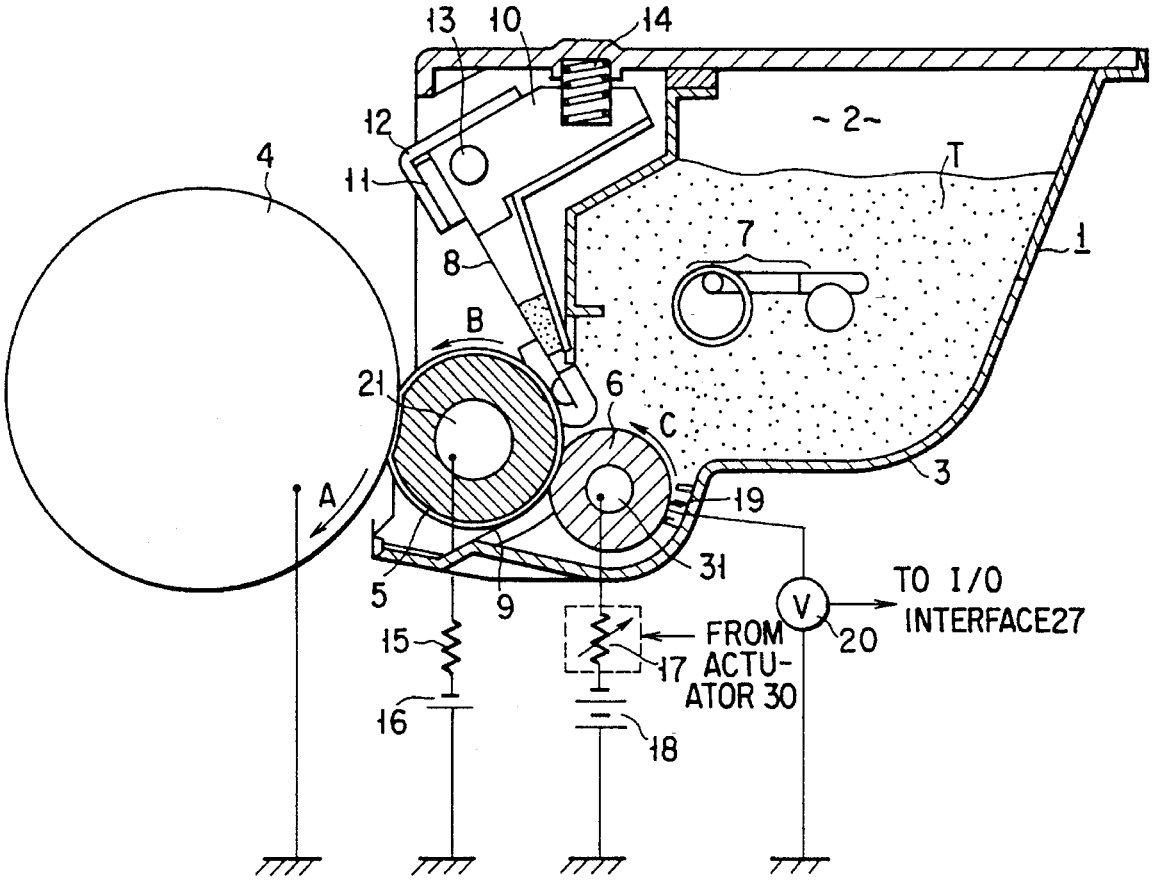
FIG. 4 shows a cross-sectional view of a developing apparatus of the one-component developer system according to another embodiment of the present invention.
Figure 5:
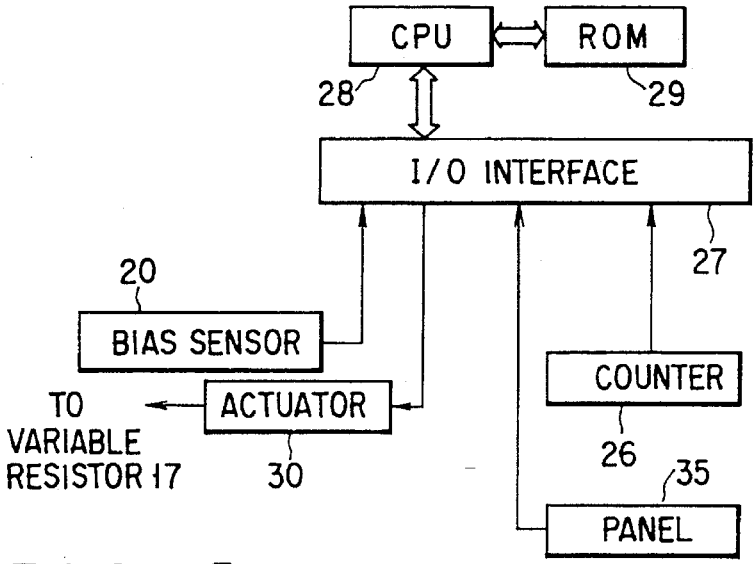
FIG. 5 shows a schematic block diagram of a control section used in connection with the arrangement shown in FIG. 4.

FIGS. 4 and 5 show another embodiment of the present invention in which the effective value of the toner supplying bias voltage of the roller 6 is monitored by using the conductive brush or electrode 19 provided inner surface of the housing 1 near to the roller 6 to have a very low resistance value into contact with the roller 6 as shown in FIG. 4. A control section for switching the voltage applied to the roller via the variable resistor 17 to keep the toner supplying bias voltage constant is shown in FIG. 5.

In FIG. 4, a volt meter 20 acting as a bias sensor is connected between the electrode 19 and the ground for measuring the effective value of the toner supplying bias voltage. The output obtained by the bias sensor 20 is supplied to the CPU 28 together with the output from the print counter 26 via the I/O interface as shown in FIG. 5. Since the remaining elements shown in FIGS. 4 and 5 are identical as shown in FIGS. 2 and 3, a detailed description thereof will be omitted here.

FIG. 2 is a flow chart showing the process of monitoring the effective value of the toner supplying bias voltage, and changing the toner supplying bias voltage. The toner supplying bias voltage is monitored as follows. As shown in FIG. 4, the conductive brush 19 having a very low resistance value is always brought into contact with the surface of the toner supply roller 6, and a voltage obtained at the brush 19 is monitored by the measuring device 20. The measured voltage is applied to the CPU 28 and is compared with a value stored in the ROM 29, thereby changing the toner supplying bias voltage.

Figure 21:
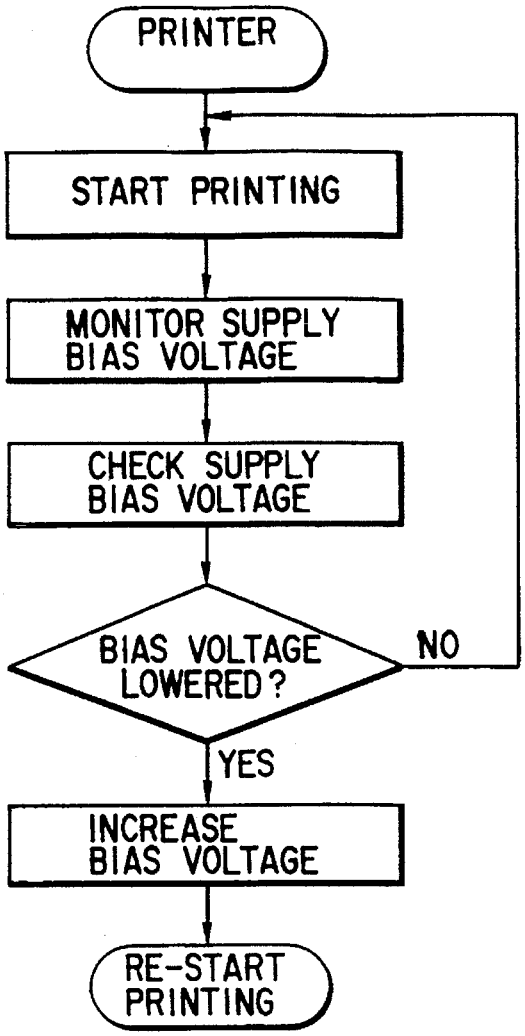
FIG. 21 is a flow chart showing the process of changing the toner supplying bias voltage upon monitoring the effective value of the toner supplying bias voltage.

As shown in FIG. 21, at the same time when the printer starts to perform printing, the toner supplying bias voltage is monitored by the measuring device 20 to be checked. If a decrease in effective value of the toner supplying bias voltage is determined, the switch 17*d* of the transformer 17 is controlled to immediately increase the toner supplying bias voltage.

In this case, as compared with the case of the first embodiment, since the optimal conditions can be maintained by constantly monitoring the toner supplying bias voltage, a stable solid pattern reproduction rate and a stable toner conveying rate can always be obtained. In addition, an increase in fogging rate on the photosensitive drum 4 can be minimized to allow a reduction in capacity of the cleaner 57 for storing a waste toner.

It has been confirmed from FIGS. 16 and 17 that if a toner supplying bias voltage of −300 V is applied, a proper solid pattern reproduction rate and a proper fogging rate on the photosensitive drum 4 can be obtained. Therefore, checking is performed to keep the effective value of the toner supplying bias voltage at −300 V.

A continuous printing test of 10,000 paper sheets was performed in the developing apparatus having the above-described arrangement, and the same printing test was performed in a developing apparatus having no arrangement for maintaining the solid pattern reproduction rate and the toner conveying rate (i.e., a conventional developing apparatus). Comparison in solid pattern reproduction rate and toner conveying rate, in the initial period and at the end of printing of 10,000 paper sheets, between these two apparatuses was performed. FIG. 24 shows the result.

It was confirmed from this result that a stable solid pattern reproduction rate and a stable toner conveying rate could be obtained even at the end of printing of 10,000 paper sheets. Referring to FIG. 4, the conductive brush 19 having a very low resistance value is used as a monitor terminal. However, the monitor terminal is not limited to the brush. For example, a thin metal plate may be arranged to be in light contact with the surface of the toner supply roller 6. That is, any member can be used as long as it has a low resistance value and can be brought into contact with the surface of the toner supply roller 6 without damaging it.

Instead of always monitoring the toner supplying bias voltage, its effective value may be monitored when the count value of the counter 26 reaches, e.g., 5,000. With this operation, the bias voltage may be changed.

Figure 6:
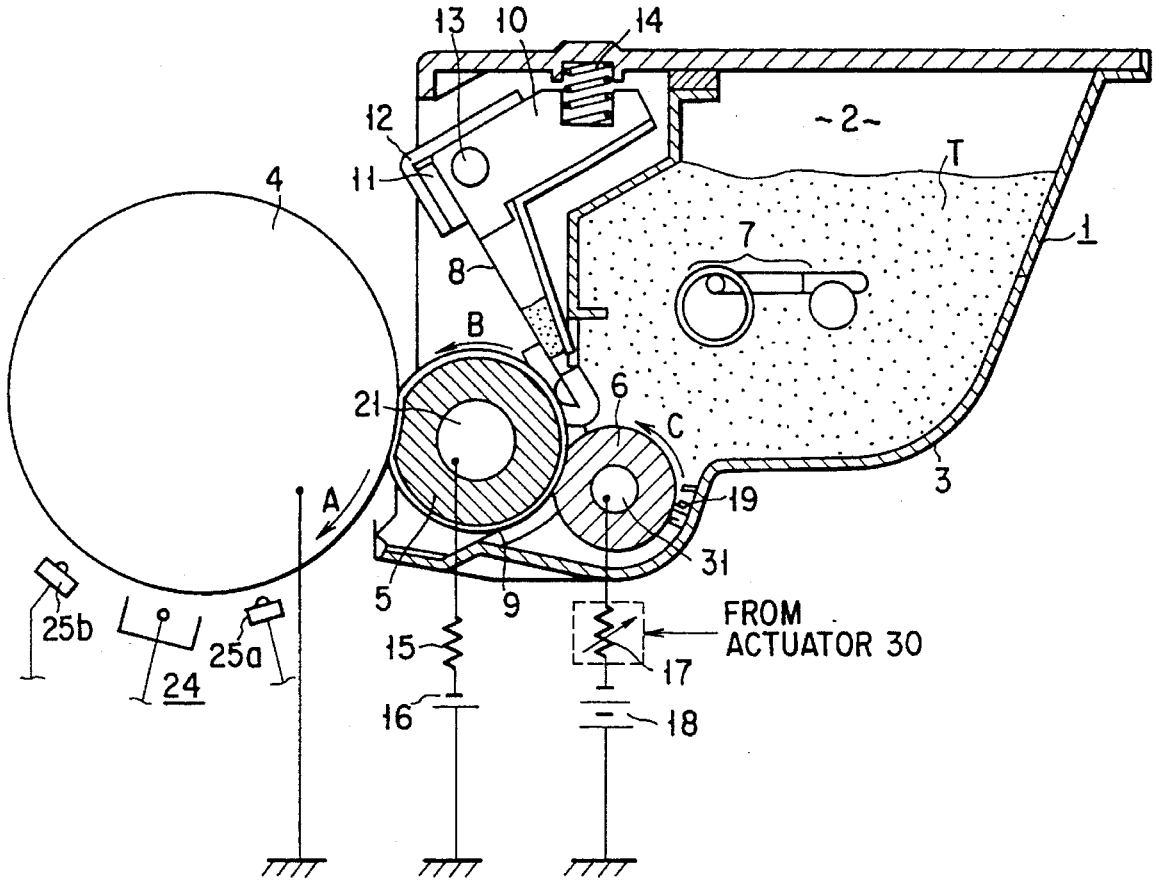
FIG. 6 shows a cross-sectional view of a developing apparatus of the one-component developer system according to another embodiment of the present invention.
Figure 7:
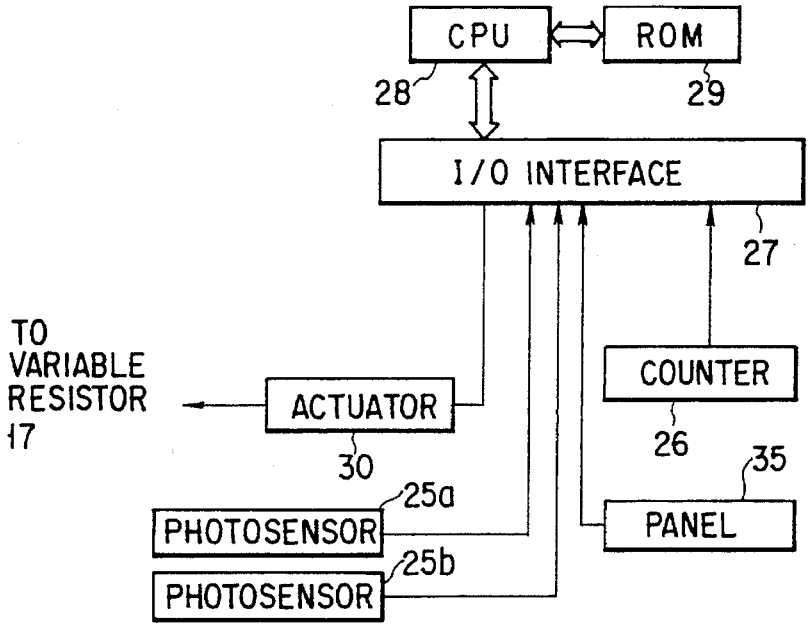
FIG. 7 shows a schematic block diagram of a control section used in connection with the arrangement shown in FIG. 4.

FIGS. 6 and 7 show a third embodiment including a means for forming a strip-like solid pattern on the photosensitive drum 4 during a warm-up period or a printing interval (paper interval), and changing the bias voltage while monitoring the toner densities of the leading and trailing ends of the strip-like solid pattern on the photosensitive drum 4 through photosensors 25*a* and 25*b* provided before and after portion of the transfer section 24 as shown in FIG. 6. When the solid pattern reproduction rate and the toner conveying rate decrease, toner layers formed after second rotation of the developing roller 5 change in thickness, resulting in a decrease in toner density on the photosensitive drum 4.

For this reason, when the count value of the counter 26 of FIG. 7 reaches the count stored on the ROM 29, a strip-like solid pattern having a length twice or more the circumference of the developing roller 5 is formed in response to strip image data supplied from the CPU 28. In the measurement result shown in FIG. 26, the length of the strip-like solid pattern on the roller 5 is plotted along the abscissa, and the pattern density based on the detection signals obtained by the photosensors 25*a* and 25*b* is plotted along the ordinate. For example, a difference ΔID between an output voltage from the photosensor 25*a* upon completion of the first rotation of the roller 5 and an output voltage from the photosensor 25*b* upon completion of the second rotation of the roller 5 is detected by the CPU 28. If this value is larger than a predetermined value stored in the ROM 29, i.e., a change in density from the leading end to the trailing end is large, the toner supplying bias voltage is changed in accordance with the table denoting the relationship between the density difference and the bias voltage. In addition, as the toner density sensors 25*a* and 25*b* for monitoring the toner density, reflective type optical devices constituted by light-emitting didoes (LEDs) and light-receiving elements are arranged on both sides of the transfer section 24.

Figures 25, 26:
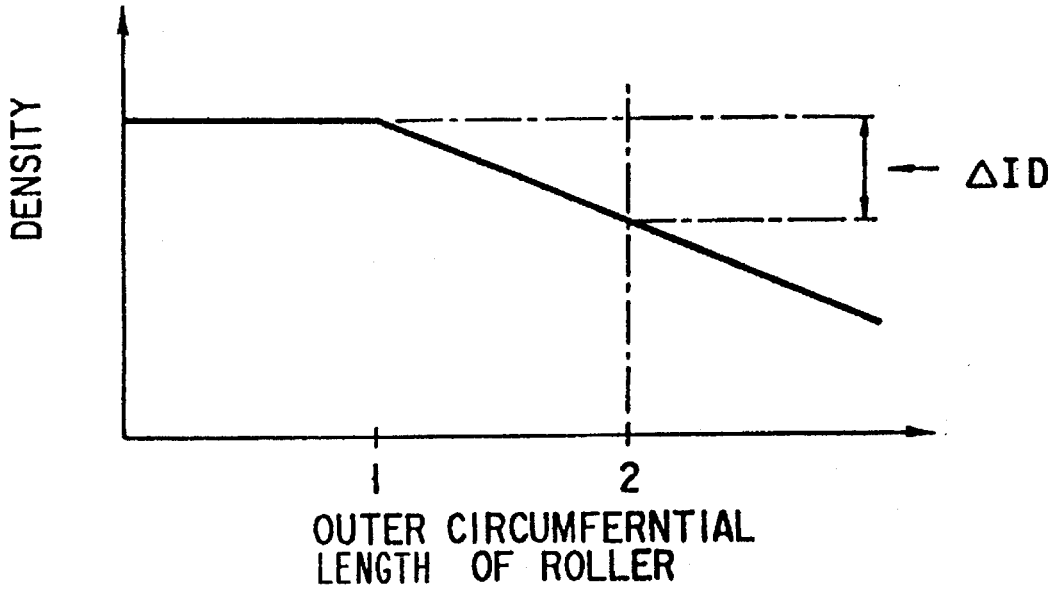
FIG. 25 is a chart showing the relationship between changes in toner density difference, the solid pattern reproduction rate, and the toner supplying bias voltage.
FIG. 26 is a graph showing the relationship between the solid pattern density and the circumference of a roller.

Experiments were conducted to check the above-described relationship between a decrease in toner density on the photosensitive drum 4 and the actual solid pattern reproduction rate, and the required toner supplying bias voltage in the developing apparatus having the above-described arrangement. FIG. 25 shows the result. Note that the toner supplying bias voltage is changed to always maintain a solid pattern reproduction rate of 90% or more.

It is obvious from the above result that a solid pattern reproduction rate of 90% can be obtained by increasing the toner supplying bias voltage to about −600 V. Furthermore, in a printing test of 10,000 paper sheets by using the apparatus of the embodiment, since the density difference is about 0.2 at the end of the test, a transformer 17 capable of applying a toner supplying bias voltage of about −600 V may be prepared.

Print patterns will be described next. As described above, when the solid pattern reproduction rate decreases, toner layers formed after the second rotation of the developing roller 5 decrease in thickness. For this reason, it is preferable that a pattern formed on the photosensitive drum 4 have a length twice or more the circumference of the developing roller 5. In the embodiment of FIGS. 6 and 7, the developing roller 5 has an outer diameter of 18mm and is rotated at a peripheral speed twice that of the photosensitive drum 4. Therefore, it is required that a pattern having a length of about 57 mm be formed on the photosensitive drum 4.

Although the longitudinal dimension (width) of the photosensitive drum 4 is basically determined by the spot size of a light beam from a toner density sensor, a width of about 1 mm to 10 mm is considered to be sufficient.

A great increase in waste toner amount is expected because of solid printing in a warm-up period or paper interval. If, however, the cleaner 57 is separated from the photosensitive drum 4 in measurement in a warm-up period to recover a toner in the developing apparatus, the toner consumption can be reduced.

In addition, the amount of the waste toner can be reduced by selecting a proper set condition for the measurement intervals (intervals of a specific number of paper sheets, at which measurement is performed) of the paper interval. In the third embodiment of the developing apparatus, the cleaning blade is separated from the photosensitive drum 4 in measurement in a warm-up period, and a solid strip pattern of 10 mm (width)× 58 mm (length) is formed by a cleaner-less scheme in which recovery of a toner is performed by the developing apparatus. In a paper interval, measurement is performed at intervals of 500 paper sheets in synchronism with the counter 26 on the printer side, and a solid strip pattern of 6 mm (width)×58 mm (length), which is smaller in width than the pattern printed in the warm-up period, is formed. In this case, the spot size of a light beam from the toner density sensor 25*a*, 25*b* is about 3 mm.

Figure 8:
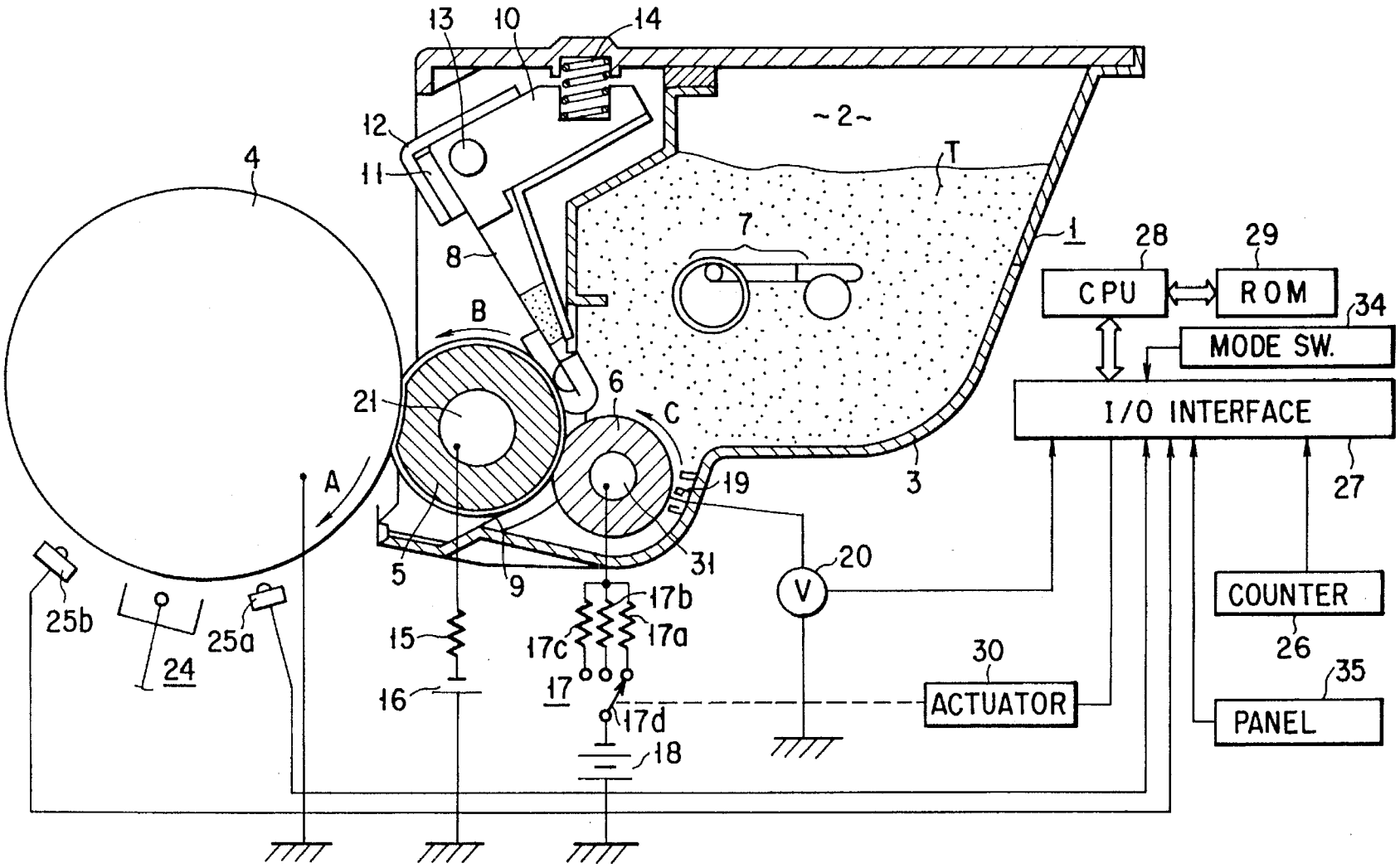
FIG. 8 is a view showing a cross-section of a developing apparatus of the one-component developer system according to still another embodiment of the present invention, together with a schematic arrangement of a block diagram of a control section.

FIG. 8 shows a fourth embodiment of the present invention in which the elements used in the first to third embodiments shown in FIGS. 2 to 7 are used so that one of the operation modes corresponding to the first to third embodiments can be selected by operating a mode switch 34 provided on the panel 35. Since the structure and circuit block diagram of the fourth embodiment of FIG. 8 is described in connection with FIGS. 2 to 7, a further explanation thereof will be omitted.

When the mode switch 34 is set to select the first mode, the print count is monitored by the CPU 28 using the contents of the counter 26. When the print count reaches at a predetermined number, 5000, for example, a driving signal is supplied to the actuator 30 to switch the variable resistor 17 to change the bias voltage of the roller 26 as shown in the first embodiment by referring to FIGS. 2 and 3. Operations of the modes set by the mode switch 34 corresponding to the second and third embodiments are identical to those of the embodiments shown in FIGS. 4 to 7.

Note that the above-described embodiments is based on a report on the experimental apparatus obtained by modifying a printer TN-7300 (print speed=12 sheets/min: A4 vertical set) available from TOSHIBA CORP. A case wherein the above-described first embodiment is applied to a printer TN-7100 (print speed=6 sheets/min: A4 vertical set) available from TOSHIBA CORP. will be described below for reference. In the interval between the initial period to the instant at which the print count becomes 1,000, a toner supplying bias voltage of −200 V is applied, which voltage has the same potential as that of the developing bias voltage. In this interval, the fogging rate on the photosensitive drum 4 is 1% or less, which is a very small value. After the print count reaches 2,000, the toner supplying bias voltage is set to be smaller than that set in the apparatus based on the TN-7300. After the print count reaches 9,000, a solid pattern reproduction rate Rd=80% or more can be maintained by applying a toner supplying bias voltage of −400 V.

That is, the toner supplying bias voltage must be properly changed in accordance with the speed (print count) of the printer and the required solid pattern reproduction rate (which may be 80% or less or needs to be about 100%, for example). In addition, as described above, means for switching the bias voltage can be selected, as needed.

In the above-described embodiments, the non-magnetic one-component developer scheme has been described, which uses a negative charging type photosensitive drum and reversal development. It is, however, apparent that the present invention can be applied to a non-magnetic one-component developer scheme using a positive charging type photosensitive drum and normal development. The major characteristic of the present invention is that the toner supplying bias voltage is properly changed in accordance with each life stage of the developer supply roller. The other arrangements may be constituted by known components.

As has been described in detail above, according to the present invention, there is provided a developing apparatus which can ensure stable supply of a developer for a long period of time without being disturbed by changes in physical properties of a developer supply roller due to its service life, and can maintain excellent image states of solid images with a small decrease in density for a long period of time.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus for forming a latent image on an image carrying member, comprising:

a developing roller for forming a developer image corresponding to said latent image on said image carrying member;

a developer supplying roller, at least a surface of which is constituted by a resilient member contacting with said developing roller for supplying the developer to said developing roller;

image transfer means for transferring the developer image formed on said image carrying member to a medium on which a visual image is being formed;

voltage applying means for applying to said developer supplying roller at least one of first and second bias voltages having a value for generating a predetermined voltage difference between said developing roller and said developer supplying roller, said second bias voltage having an absolute value larger than that of the first bias voltage;

measuring means for measuring a surface potential of said developer supplying roller; and means for changing the first bias voltage applied by said voltage applying means to said second bias voltage to generate a predetermined potential difference between said developer supplying roller and said developing roller in accordance with a measuring result of said measuring means.

2. An image forming apparatus according to claim 1, wherein said developer is a one-component developer.

3. An image forming apparatus according to claim 2, wherein said developing roller is made of a resilient material having an electric conductive property, and said developer supply roller comprises a center shaft made of an electric conductive material and an electric conductive roller body provided on the center shaft, said roller body being made of a conductive urethane foam.

4. An image forming apparatus according to claim 1, wherein said developing roller is made of a resilient material having an electric conductive property, and said developer supply roller comprises a center shaft made of an electric conductive material and an electric conductive roller body provided on the center shaft, said roller body being made of a conductive urethane foam.

5. An image forming apparatus according to claim 1, further comprising a first voltage source for supplying a developing voltage to said developer roller and a second voltage source included in said bias voltage applying means for applying one of said first and second bias voltages via said switching unit.

6. An image forming apparatus according to claim 1, wherein said changing means includes a variable resistor having a first resistor for generating the first bias voltage and a second resistor for generating the second bias voltage.

7. An image forming apparatus according to claim 1, wherein said measuring means includes a brush-like electrode contacting to a surface of the developer supply roller and a voltmeter connected to the electrode to detect a potential of the surface of the developer supply roller.

8. An image forming apparatus for forming a latent image on an image carrying member, comprising:

a developing roller for forming a developer image corresponding to said latent image on said image carrying member;

a developer supplying roller, at least a surface of which is constituted by a resilient member contacting with said developing roller for supplying the developer to said developing roller;

image transfer means for transferring the developer image formed on said image carrying member to a medium on which a visual image is being formed;

voltage applying means for applying to said developer supplying roller at least one of first and second bias voltages having a value for generating a predetermined voltage difference between said developing roller and said developer supplying roller, said second bias voltage having an absolute value larger than that of the first bias voltage;

measuring means for measuring a developing density of the developer image formed on said image carrying member; and means for changing the first bias voltage applied by said voltage applying means to said second bias voltage to generate a predetermined potential difference between said developer supplying roller and said developing roller in accordance with a measuring result of said measuring means.

9. An image forming apparatus according to claim 8, wherein said developer is a one-component developer.

10. An image forming apparatus according to claim 9, wherein said developing roller is made of a resilient material having an electric conductive property, and said developer supply roller comprises a center shaft made of an electric conductive material and an electric conductive roller body provided on the center shaft, said roller body being made of a conductive urethane foam.

11. An image forming apparatus according to claim 8, wherein said developing roller is made of a resilient material having an electric conductive property, and said developer supply roller comprises a center shaft made of an electric conductive material and an electric conductive roller body provided on the center shaft, said roller body being made of a conductive urethane foam.

12. An image forming apparatus according to claim 8, further comprising a first voltage source for supplying a developing voltage to said developer roller and a second voltage source included in said bias voltage applying means for applying one of said first and second bias voltages via said switching unit.

13. An image forming apparatus according to claim 8, wherein said changing means includes a variable resistor having a first resistor for generating the first bias voltage and a second resistor for generating the second bias voltage.

14. An image forming apparatus according to claim 8, wherein said measuring means includes means for forming a developer image of a strip-like test pattern having a leading portion and an end portion along an outer circumferential surface of said developing roller, a first photosensor for detecting a first developing density of the leading portion, a second photosensor for detecting a second developing density of the end portion, and means for obtaining a difference between the first and second developing densities as said measuring result.

* * * * *